US006835146B2

(12) United States Patent
Jordan et al.

(10) Patent No.: US 6,835,146 B2
(45) Date of Patent: Dec. 28, 2004

(54) GOLF BALL WITH HIGH COEFFICIENT OF RESTITUTION

(75) Inventors: Michael D Jordan, East Greenwich, RI (US); Michael J Sullivan, Barrington, RI (US); Herbert C Boehm, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 14 days.

(21) Appl. No.: 10/241,305

(22) Filed: Sep. 11, 2002

(65) Prior Publication Data

US 2003/0022731 A1 Jan. 30, 2003

Related U.S. Application Data

(63) Continuation-in-part of application No. 09/821,641, filed on Mar. 29, 2001, now Pat. No. 6,595,874, which is a continuation-in-part of application No. 09/447,653, filed on Nov. 23, 1999, now Pat. No. 6,485,378.

(51) Int. Cl.[7] ..... A63B 37/06
(52) U.S. Cl. ..... 473/377

(58) Field of Search ..... 473/351, 377, 473/373, 374

(56) References Cited

U.S. PATENT DOCUMENTS

| | | | | |
|---|---|---|---|---|
| 5,104,126 | A | 4/1992 | Gentiluomo | 273/228 |
| 5,209,485 | A | 5/1993 | Nesbitt et al. | 273/218 |
| 5,803,831 | A | 9/1998 | Sullivan et al. | 473/374 |
| 6,443,858 | B2 | 9/2002 | Bartels et al. | 473/351 |
| 6,485,378 | B1 * | 11/2002 | Boehm | 473/374 |
| 6,595,874 | B2 * | 7/2003 | Sullivan et al. | 473/374 |
| 2002/0045495 | A1 | 4/2002 | Nesbitt et al. | 473/370 |

* cited by examiner

*Primary Examiner*—Raeann Gorden
(74) *Attorney, Agent, or Firm*—William B. Lacy

(57) ABSTRACT

A golf ball comprising an inner core, an outer core, and a cover is disclosed. The outer core surrounds the inner core, and the cover encases the cores. The inner core is preferably a pre-formed symmetrical, non-spherical insert, which may be made from a rigid material to improve the CoR and initial velocity of the ball at high impact speeds. The outer core is preferably over-molded around the pre-formed insert to form a spherical core.

50 Claims, 4 Drawing Sheets

GOLF BALL WITH HIGH COEFFICIENT OF RESTITUTION

CROSS-REFERENCE TO RELATED APPLICATIONS

The present application is a continuation-in-part of U.S. patent application Ser. No. 09/821,641 filed on Mar. 29, 2001, now U.S. Pat. No. 6,598,874, which is a continuation-in-part of U.S. patent application Ser. No. 09/447,653 filed on Nov. 23, 1999, now U.S. Pat. No. 6,485,378. The disclosures of the parent patent applications are incorporated herein in their entireties.

FIELD OF THE INVENTION

This invention generally relates to golf balls with high coefficient of restitution, and more particularly to a low deformation golf ball at high club speeds.

BACKGROUND OF THE INVENTION

Golf balls have been designed to provide particular playing characteristics. These characteristics generally include initial ball velocity, coefficient of restitution (CoR), compression, weight distribution and spin of the golf ball, which can be optimized for various types of players.

Golf balls can generally be divided into two classes: solid and wound. Solid golf balls include single-layer, dual-layer (i.e., solid core and a cover), and multi-layer (i.e., solid core of one or more layers and/or a cover of one or more layers) golf balls. Wound golf balls typically include a solid, hollow, or fluid-filled center, surrounded by tensioned elastomeric thread, and a cover.

Generally, if a dual-layer solid golf ball has a soft core and a hard cover, it has a low spin rate. If the solid golf ball has a hard core and a hard cover, it exhibits very high resiliency for distance but has a "hard" feel, and is difficult to control on the greens. Additionally, if the golf ball has a hard core and a soft cover, it will have a high rate of spin. More recently developed solid balls have a core, at least one intermediate layer, and a cover. The intermediate layers improve the playing characteristics of solid balls, and can be made from thermoset or thermoplastic materials. In an effort to improve various properties of golf balls further, symmetrical, non-spherical cores and core layer have been contemplated in the patent literature.

Several patents are directed to inner cores that have been modified with non-spherical features such as bores or projections.

U.S. Pat. No. 720,852 issued to Smith discloses an internal core with small, solid protuberances projecting therefrom. The core is encased in a rubber layer having small, solid protuberances projecting therefrom. A silk layer is wound thereto, and then the ball is encased in an outer covering. The non-spherical core protuberances anchor the rubber and silk layers and increase the resiliency of the ball as a whole.

U.S. Pat. No. 1,524,171 issued to Chatfield discloses a core with a hollow, spherical center that supports cylindrical, solid lugs. A spherical casing surrounds and abuts the tips of the lugs. The lugs and casing are designed so that the casing compresses the lugs in the finished ball. Fluid or wound rubber bands occupy the space around the lugs, between the spherical center and the casing. The non-spherical lugs promote the accurate location of the center by facilitating uniform and spherical winding of the rubber bands about the center. An outer shell surrounds the casing.

U.K. Patent Application No. 2,162,072 issued to Slater discloses a golf ball with a non-spherical inner core that includes solid, support members or struts that diverge from a common center. The struts form a generally cubic, tetrahedral, or octahedral shaped core. The struts locate the inner core symmetrically within a mold cavity. An outer core is molded about the inner core, and a cover is molded thereon. The inner and outer cores are formed from identical or similar materials.

U.S. Pat. No. 5,480,143 issued to McMurry discloses a substantially spherical practice ball comprising mutually perpendicular members with a plurality of walls that interconnect the members. The walls increase the drag on the ball so that smaller playing fields can be used.

U.S. Pat. No. 5,836,834 issued to Masutani et al. discloses a two or three-piece golf ball comprising a two-layer solid core composed of a low-hardness inner core and a high-hardness outer core joined around the low-hardness inner core. A projection is formed on the inner surface of the high-hardness outer core such that the projection extends along an approximate normal direction, while a depression corresponding to the projection is formed in the outer surface of the low-hardness inner core, and the low-hardness inner core and the high-hardness outer core are joined together such that the projection is inserted into the depression.

Other patents disclose adding perimeter weights to golf balls to increase its moment of inertia. U.S. Pat. No. 5,984,806 discloses a golf ball with visible perimeter weights disposed on a spherical inner cover.

However, the prior art does not contemplate using non-spherical cores to improve the CoR of golf balls.

SUMMARY OF THE INVENTION

Hence, the invention is directed to a golf ball having core geometry designed to provide improved playing characteristics such as coefficient of restitution.

The invention is also directed to provide a golf ball having an inner core that comprises a pre-formed non-spherical core insert or inner core.

These and other objects of the present invention are realized by a golf ball comprising a core, which comprises a pre-formed non-spherical insert embedded within a polymeric core material and is encased by a cover. The golf ball has a coefficient of restitution of at least 0.810 at a collision speed of about 125 feet per second or higher. Preferably, the coefficient of restitution is at least 0.790 at collision speed of about 140 feet per second or higher, and more preferably the coefficient of restitution is at least 0.760 at collision speed of about 160 feet per second or higher.

In accordance to another aspect of the invention, the golf ball has a first coefficient of restitution of at least 0.810 at a collision speed of about 160 feet per second or higher against a flexible impact surface, wherein the impact surface has a second coefficient of restitution of about 0.830.

The pre-formed non-spherical insert has a flexural modulus in the range of about 25,000 psi to about 250,000 psi. More preferably, the pre-formed non-spherical insert has a flexural modulus in the range of about 75,000 psi to about 225,000 psi, and most preferably the pre-formed non-spherical insert has a flexural modulus in the range of about 80,000 psi to about 200,000 psi.

Furthermore, the flexural modulus of the polymeric core material is at least about 500 psi less than the flexural modulus of the pre-formed non-spherical insert. Preferably, the flexural modulus of the polymeric core material is at least about 1000 psi less than the flexural modulus of the pre-formed non-spherical insert. More preferably, the flexural modulus of the polymeric core material is about 20,000 psi to about 50,000 psi less than the flexural modulus of the pre-formed non-spherical insert. Most preferably, the flexural modulus of the polymeric core material is at least about 100,000 psi less than the flexural modulus of the pre-formed non-spherical insert.

In accordance to another aspect of the invention, the pre-formed non-spherical insert has compression in the range of about 50 Atti to about 120 Atti. Preferably, the pre-formed non-spherical insert has compression in the range of about 60 Atti to about 110 Atti. More preferably, the pre-formed non-spherical insert has compression in the range of about 80 Atti to about 100 Atti.

Furthermore, the compression of the polymeric core material is about 5 to 100 Atti less than the compression of the pre-formed non-spherical insert. Preferably, the compression of the polymeric core material is about 20 to 80 Atti less than the compression of the pre-formed non-spherical insert. More preferably, the compression of the polymeric core material is about 30 to 60 Atti less than the compression of the pre-formed non-spherical insert.

In accordance to another aspect of the present invention, the pre-formed non-spherical insert has a hardness of greater than about 40 Shore D. Preferably, the preformed non-spherical insert has a hardness of greater than about 60 Shore D. More preferably, the pre-formed non-spherical insert has a hardness of greater than about 65 Shore D. Furthermore, the hardness of the polymeric material is at least about 1 Shore D less than the hardness of the insert.

In accordance to one aspect of the invention, the pre-formed non-spherical insert is symmetrical, and comprises a central portion and a plurality of projections. The projections comprise a substantially conical head disposed at the distal end of each projection. The outermost surfaces of the conical heads lie on a spherical surface. The projections are separated by predetermined gaps.

In accordance to another aspect of the present invention, the insert comprises a plurality of connected rods and a plurality of balls disposed at the distal ends of the rods. Alternatively, the balls may assume mushroom or anchor shape. Furthermore, the insert further comprises a hub connected to the rods.

In accordance to another aspect of the present invention, the insert comprises a plurality of interconnected rings and/or a center. Alternatively, the insert comprises a plurality of interconnected disks. Furthermore, the insert may comprise a hollow shell having openings on its surface. The shell may comprise rigid chambers on its surface, which may have a center hub connected to the shells by rods.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
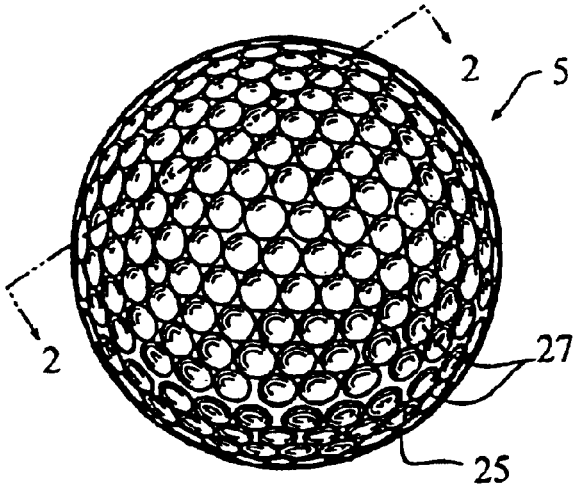
FIG. 1 is a front view of a golf ball according to the present invention.

Initial velocity of a golf ball after impact with a golf club is governed by the United States Golf Association ("USGA"). The USGA requires that a regulation golf ball can have an initial velocity of no more than 250 feet per second±2% or 255 feet per second. The USGA initial velocity limit is related to the ultimate distance that a ball may travel (280 yards±6%), and is also related to the coefficient of restitution ("CoR"). The coefficient of restitution is the ratio of the relative velocity between two objects after direct impact to the relative velocity before impact. As a result, the CoR can vary from 0 to 1, with 1 being equivalent to a perfectly or completely elastic collision and 0 being equivalent to a perfectly plastic or completely inelastic collision. Since a ball's CoR directly influences the ball's initial velocity after club collision and travel distance, golf ball manufacturers are interested in this characteristic for designing and testing golf balls.

One conventional technique for measuring CoR uses a golf ball or golf ball subassembly, air cannon, and a stationary vertical steel plate. The steel plate provides an impact surface weighing about 100 pounds or about 45 kilograms. A pair of ballistic light screens, which measure ball velocity, are spaced apart and located between the air cannon and the steel plate. The ball is fired from the air cannon toward the steel plate over a range of test velocities from 50 ft/s to 180 ft/sec. As the ball travels toward the steel plate, it activates each light screen so that the time at each light screen is measured. This provides an incoming time period proportional to the ball's incoming velocity. The ball impacts the steel plate and rebounds though the light screens, which again measure the time period required to transit between the light screens. This provides an outgoing transit time period proportional to the ball's outgoing velocity. The coefficient of restitution can be calculated by the ratio of the outgoing transit time period to the incoming transit time period.

Another CoR measuring method uses a substantially fixed titanium disk. The titanium disk intending to simulate a golf club is circular, and has a diameter of about 4 inches, and has a mass of about 200 grams. The impact face of the titanium disk may also be flexible and has its own coefficient of restitution, as discussed further below. The disk is mounted on an X-Y-Z table so that its position can be adjusted relative to the launching device prior to testing. A pair of ballistic light screens are spaced apart and located between the launching device and the titanium disk. The ball is fired from the launching device toward the titanium disk at a predetermined test velocity. As the ball travels toward the titanium disk, it activates each light screen so that the time period to transit between the light screens is measured. This provides an incoming transit time period proportional to the ball's incoming velocity. The ball impacts the titanium disk, and rebounds through the light screens which measure the time period to transit between the light screens. This provides an outgoing transit time period proportional to the ball's outgoing velocity. The CoR can be calculated by the ratio of the outgoing time difference to the incoming time difference.

Solid golf balls with soft core have been utilized to provide balls with good feel for better control. Recently, a soft core has been developed that is also capable of high initial velocity when impacted by a driver club. Such technology is discussed in commonly owned co-pending patent application entitled "Low Spin Soft Compression Performance Golf Ball", bearing Ser. No. 09/992,448 and filed on Nov. 16, 2001. An example of such technology is a core formed of polybutadiene rubber with Mooney viscosity of about 40 to about 60. The core may have other softeners, such as zinc pentachlorothiophenol (ZnPCTP) and pentachlorothiophenol (PCTP), among others, to improve feel and to improve the velocity of the ball after impact at low compression. The compression of such core is less than 60 Atti and more preferably in the range of 20 to 60, and most preferably in the range of 30 to 60.

Compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

$$\text{(Atti or PGA compression)}=\text{(160-Riehle Compression)}.$$

Thus, a Riehle compression of 100 would be the same as an Atti compression of 60.

Golf balls made with such cores enjoy high CoR at relatively low club speeds. The CoR of these balls is higher than the CoR of similar balls with higher compression core at relatively low club speeds. At higher club speeds, however, the CoR of golf balls with low compression core can be lower than the CoR of balls with higher compression core. As illustrated herein, a first golf ball with a 1.505 inch core and a core compression of 48 (hereinafter "Sample-48") and a second golf ball with a 1.515 inch core and a core compression of 80 (hereinafter "Sample-80") were subject to the following distance and CoR tests. Sample-48 and Sample-80 have essentially the same size core and similar dual-layer cover. The single most significant difference between these two balls is the compression of the respective cores.

| | | Ball Speed (feet per second) | | | |
|---|---|---|---|---|---|
| | Compression On Ball | Average Driver Set-up | Standard Driver Set-up | Pro 167 Driver Set-up | Big Pro 175 Driver Set-up |
| Sample-48 | 86 | 141.7 | 162.3 | 167.0 | 175.2 |
| Sample-80 | 103 | 141.5 | 162.1 | 168.9 | 176.5 |
| | | Coefficient of Restitution (CoR) | | | |
| | Compression On Ball | Mass Plate (125 ft/s) | Mass Plate (160 ft/s) | 200-gram Solid Plate (160 ft/s) | 199.8-gram Calibration Plate (160 ft/s) |
| Sample-48 | 86 | 0.812 | 0.764 | 0.759 | 0.818 |
| Sample-80 | 103 | 0.796 | 0.759 | 0.753 | 0.836 |
| Difference (Sample-48 – Sample-80) | | +0.016 | +0.005 | +0.006 | −0.018 |

A "Mooney" viscosity is a unit used to measure the plasticity of raw or unvulcanized rubber. The plasticity in a Mooney unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

As used in the ball speed test, the "average driver set-up" refers to a set of launch conditions, i.e., at a club head speed to which a mechanical golf club has been adjusted so as to generate a ball speed of about 140 feet per second. Similarly, the "standard driver set-up" refers to similar ball speed at launch conditions of about 160 feet per second; the "Pro 167 set-up" refers to a ball speed at launch conditions of about 167 feet per second; and the "Big Pro 175 set-up" refers to a ball speed at launch conditions of about 175 feet per second. Also, as used in the CoR test, the mass plate is a 45-kilogram plate (100 lbs.) against which the balls strike at the indicated speed. The 200-gram solid plate is a smaller mass that the balls strike and resembles the mass of a club head. The 199.8-gram calibration plate resembles a driver with a flexible face that has a CoR of 0.830.

The ball speed test results show that while Sample-48 holds a ball speed advantage at club speeds of 140 feet per second to 160 feet per second launch conditions, Sample-80 decidedly has better ball speed at 167 feet per second and 175 feet per second launch conditions.

Similarly, the CoR test results show that at the higher collision speed (160 feet per second), the CoR generally goes down for both balls, but the 199.8-gram calibration test shows that the CoR of the higher compression Sample-80 is significantly better than the lower compression Sample-48 at the collision speed (160 feet per second). Additionally, while the CoR generally goes down for both balls, the rate of decrease is much less for Sample-80 than for Sample-48. Unless specifically noted, CoR values used hereafter are measured by either the mass plate method or the 200-gram solid plate method, i.e., where the impact plate is not flexible.

Additionally, the average non-flexible CoR for Sample-48 at 160 feet per second is about 0.761 and for Sample-80 is about 0.756. The CoR for Sample-48 at about 140 feet per second can be interpolated to be about 0.790, and the CoR for Sample-80 at about 140 feet per second can be interpolated to about 0.780.

Without being limited to any particular theory, the inventors of the present invention believe that at high impact, the ball with lower core compression deforms more than the ball with higher core compression. Such deformation negatively affects the initial velocity and CoR of the ball.

Figure 6A:
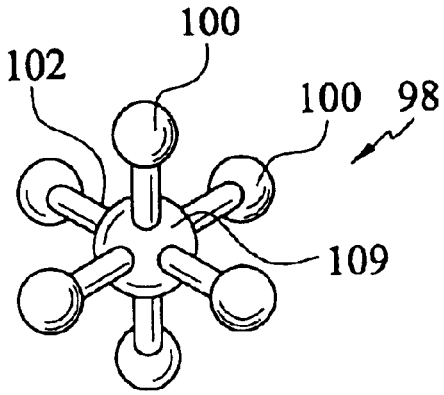
FIGS. 6(*a*)–6(*c*) are side views of other embodiments of the inner core in accordance to the present invention.
Figure 6B:
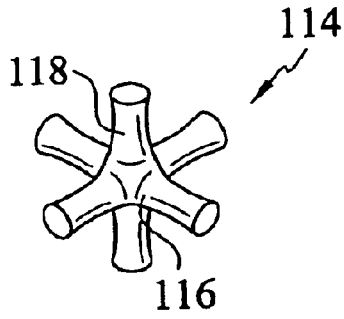
Figure 6C:
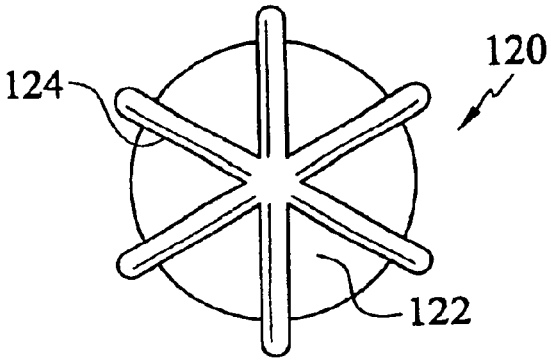
Figure 7A:
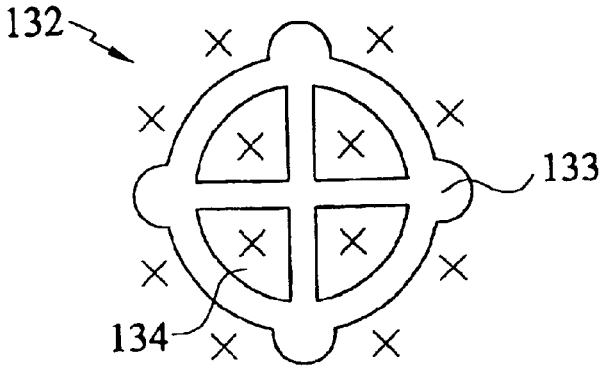
FIGS. 7(*a*)–7(*c*) are side views of other embodiments of the inner core in accordance to the present invention.
Figure 7B:
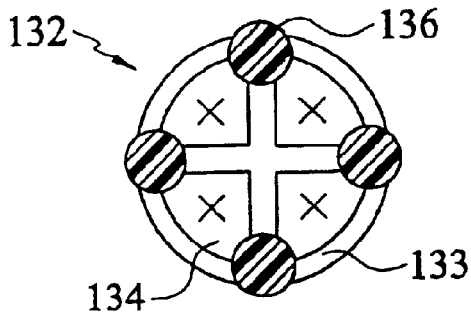
Figure 7C:
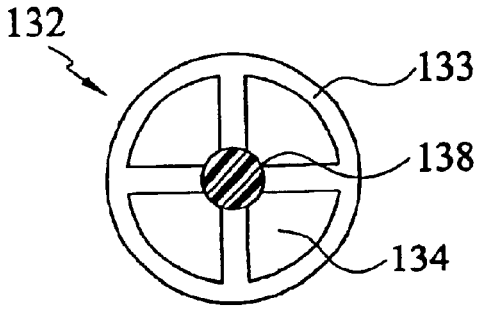

In accordance to one aspect of the present invention, symmetrical, non-spherical rigid inserts, such as inner core 10, illustrated in FIGS. 1–4 and pre-formed inserts 84, 90, 92, 94, 98, 114, 120 and 132 illustrated in FIGS. 5 through 7 are incorporated into the golf ball to improve CoR at high impact speeds. These embodiments are fully described in the co-pending parent patent application Ser. No. 09/821,641, which has been incorporated by reference in its entirety. While the present inventions is discussed in connection with improving the CoR, initial velocity and other properties of cores with low compression and high initial velocity, it is understood that the present invention is applicable to improving the CoR and initial velocity of all solid cores.

Figure 2:
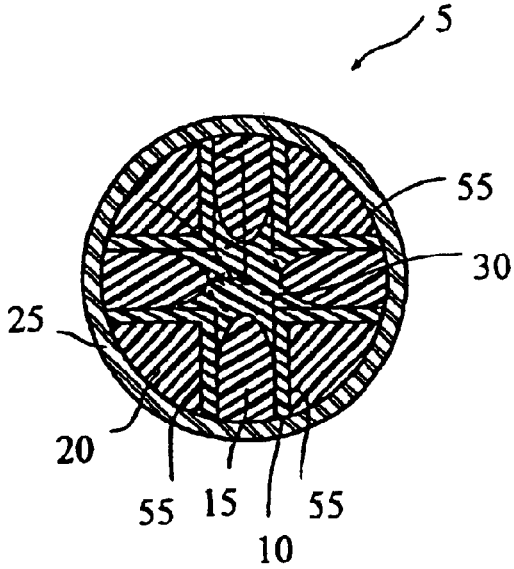
FIG. 2 is a cross-sectional view along the line 2—2 of FIG. 1 of the golf ball according to the present invention.
Figure 3:
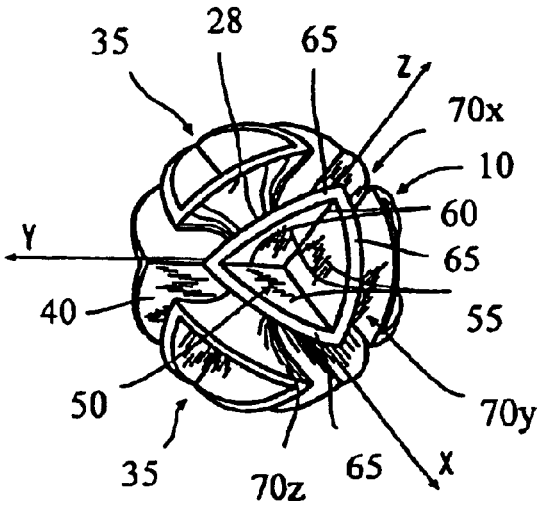
FIG. 3 is a side view of an inner core of the golf ball shown in FIG. 2.
Figure 4:
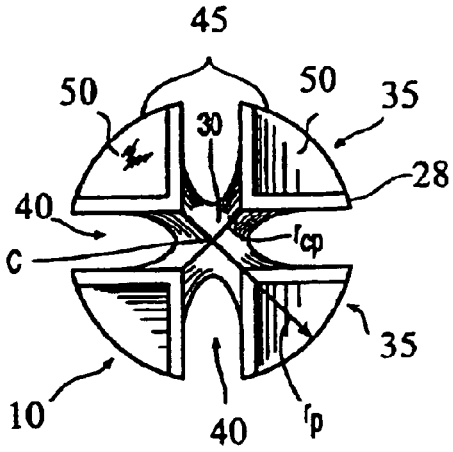
FIG. 4 is a plan view along the arrow 4 of FIG. 3 of the inner core according to the present invention.
Figure 5A:
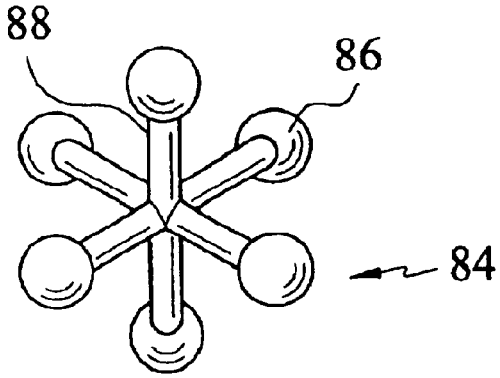
FIGS. 5(*a*)–5(*d*) are side views of other embodiments of the inner core in accordance to the present invention.
Figure 5B:
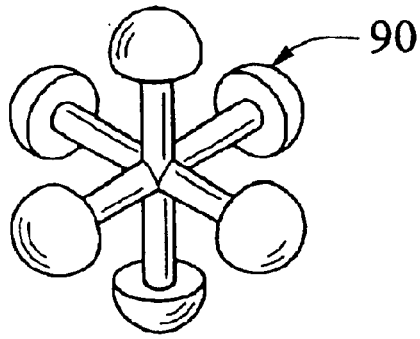
Figure 5C:
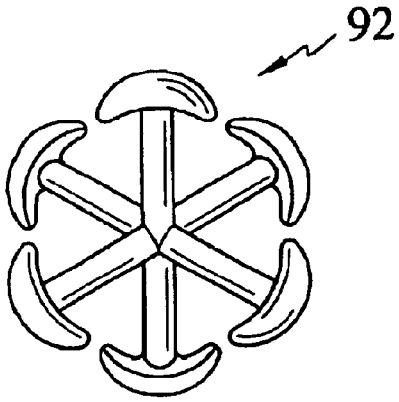
Figure 5D:
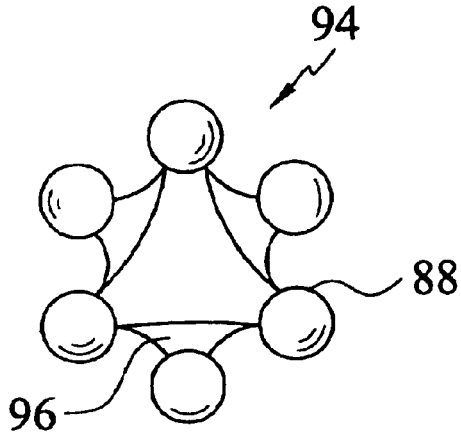

Referring to FIG. 1, inner core 10 is the inner most layer of golf ball 5, which also has outer cores 15 and 20 and cover 25. Cover 25 has a plurality of dimples 27 formed on the outer surface thereof. Referring to FIGS. 2–4, inner core 10 includes a discontinuous spherical outer surface 28, a center C, a central portion 30, and a plurality of projections 35. The central portion 30 and projections 35 are preferably integrally formed, so that inner core 10 is a unitary piece to maximize its strength and rigidity. Preferably, inner core 10 is a pre-formed insert that can be over-molded with other materials to form the core of the golf ball.

Referring to FIGS. 3 and 4, inner core 10 is defined by at least two radial distances, $r_{cp}$ and $r_p$. Radius $r_{cp}$ defines the relatively small central portion 30 of inner core 10. The central portion 30 is solid in this embodiment but may be hollow. Radius $r_p$, on the other hand, defines the outer surface 28 of projections 35 of inner core 10. Each of the projections 35 extends radially outwardly from central portion 30, and the projections are spaced from one another by gaps 40. Preferably, projections 35 are shaped and spaced, so that the inner core 10 is substantially symmetrical. Additionally, outer surface 28 of projections 35 is equally spaced from center C, so that outer surface 28 lies on a spherical surface symmetrically and radially spaced by distance $r_p$ from center C. Hence, inner core 10 can be located concentrically inside ball 5, when center C of inner core 10 coincides with the center of ball 5.

Each projection 35 has an enlarged free distal end 45, which has substantially a conical shape. Each distal end 45 includes an open recess 50 formed by three sidewalls 55. Each of the sidewalls 55 is shaped like a flat quarter circle. The quarter circle includes two straight edges 60 joined by a curved edge 65. In each projection 35, each of the sidewalls 55 is joined at the straight edges 60. The curved edges 65 of the projections actually form the outer surface 28 of inner core 10, and allow inner core 10 to have a spherical outline.

With reference to a three-dimensional Cartesian coordinate system, there are perpendicular x, y, and z axes, respectively, that form eight octants. There are preferably eight projections 35 with one in each octant of the coordinate system, so that each of the projections 35 forms an octant of the skeletal sphere. Thus, the inner core is symmetrical. The gaps 40 define three perpendicular concentric rings $\mathbf{70}_x$, $\mathbf{70}_y$, and $\mathbf{70}_z$. The subscript for the reference number 70 designates the central axis of the ring about which the ring circumscribes.

Turning to FIGS. 2 and 4, the outer core includes a first section 15 and a second section 20. The first section 15 fills the gaps 40 around the projections 35, and is disposed between the sidewalls 55 of adjacent projections 35. It is preferred that the diameter of the core, which includes the inner core and the outer core is between about 1.00 inches and about 1.64 inches for a ball having a diameter of 1.68 inches.

The second section 20 fills the recesses 50 of each projection 35, and is disposed between the sidewalls 55 of a single projection 35. The outer core is formed so that the outer core terminates flush with the free end 45 of each projection 35. The outer core, thus, has a substantially spherical outer surface. The cover 25 is formed about the inner core 10 and the outer core sections 15 and 20, so that both the inner and outer cores abut the cover. Alternatively, outer core sections 15 and 20 may extend beyond inner core 10 and completely encase inner core 10. In this embodiment, the cover 25 is formed about outer core 15 and 20.

The formation of a golf ball starts with forming the inner core 10. As discussed above, inner core 10 is preferably pre-formed as an integral insert. The inner core 10, outer core sections 15 and 20, and the cover 25 can be formed by compression molding, by injection molding, or by casting. These methods of forming cores and covers of this type are well known in the art.

The inner and outer core materials preferably have substantially different material properties so that there is a predetermined relationship between the inner and outer core materials, to achieve the desired playing characteristics of the ball, such as the CoR of the ball at relatively high impact speeds. For instance, inner core 10 may be constructed from a rigid material having a high flexural modulus. Outer core sections 15 and 20, on the other hand, are preferably made from a soft, low compression material, such as polybutadiene rubber with Mooney viscosity of about 40 to about 60 blended with halogenated organosulphur compounds, e.g., PCTP and or metal salts of halogenated organosulphur compounds, e.g., ZnPCTP. Since, the outer core sections 15 and 20 are soft and fast, golf ball 5 has high initial velocity and longer distance when struck at relatively lower club speeds, and due to the rigidity of the supporting inner core 10, which is evenly distributed throughout the core, the core is capable of resisting deformation at higher club speeds to preserve the initial velocity, distance and CoR.

Inner core 10 is preferably made from a durable material such as metal, rigid plastics, or polymers re-enforced with high strength organic or inorganic fillers or fibers, or blends or composites thereof, as discussed below. Suitable plastics or polymers include, but not limited to, one or more of partially or fully neutralized ionomers including those neutralized by a metal ion source wherein the metal ion is the salt of an organic acid, polyolefins including polyethylene, polypropylene, polybutylene and copolymers thereof including polyethylene acrylic acid or methacrylic acid copolymers, or a terpolymer of ethylene, a softening acrylate class ester such as methyl acrylate, n-butyl-acrylate or iso-butyl-acrylate, and a carboxylic acid such as acrylic acid or methacrylic acid (e.g., terpolymers including polyethylene-methacrylic acid-n or iso-butyl acrylate and polyethylene-acrylic acid-methyl acrylate, polyethylene ethyl or methyl acrylate, polyethylene vinyl acetate, polyethylene glycidyl alkyl acrylates). Suitable polymers also include metallocene catalyzed polyolefins, polyesters, polyamides, non-ionomeric thermoplastic elastomers, copolyether-esters, copolyether-amides, thermoplastic or thermosetting polyurethanes, polyureas, polyurethane ionomers, epoxies, polycarbonates, polybutadiene, polyisoprene, and blends thereof. Suitable polymeric materials also include those listed in U.S. Pat. Nos. 6,187,864, 6,232,400, 6,245,862, 6,290,611 and 6,142,887 and in PCT publication no. WO 01/29129.

Another readily apparent advantage of an invention is that highly rigid materials, such as certain metals, can now be used in a golf ball, because the rigidity of the materials can resist the deformation of the softer outer core 15 and 20. Suitable rigid metals include, but not limited to, tungsten, steel, titanium, chromium, nickel, copper, aluminum, zinc, magnesium, lead, tin, iron, molybdenum and alloys thereof.

Suitable highly rigid materials include those listed in columns 11, 12 and 17 of U.S. Pat. No. 6,244,977. Fillers with very high specific gravity such as those disclosed in U.S. Pat. No. 6,287,217 at columns 31–32 can also be incorporated into the inner core 15. Suitable fillers and composites include, but not limited to, carbon including graphite, glass, aramid, polyester, polyethylene, polypropylene, silicon carbide, boron carbide, natural or synthetic silk.

Suitable outer core polymers include, but are not limited to, any polymers comprising natural rubbers, including cis-polyisoprene, trans-polyisoprene or balata, synthetic rubbers including 1,2-polybutadiene, cis-polybutadiene, trans-polybutadiene, polychloroprene, poly(norbornene), polyoctenamer and polypentenamer among other diene polymers.

Other suitable diene polymeric materials, which can be cross-linked with metal salt diacrylate, dimethacrylate or monomethacrylate reactive co-agent, further include metallocene catalyzed diene polymers, copolymers and terpolymers such as metallocene catalyzed polybutadiene, ethylene propylene rubber, ethylene-propylene-diene monomer terpolymers (EPDM), butadiene-styrene polymers, isoprene, copolymers with functionalized monomers (polar groups), among others. As used herein, the term "metallocene catalyzed" includes polymerization catalyzed by metallocenes, which generally consist of a positively charged metal ion sandwiched between two negatively charged cyclopentadienyl anions, and other single-site catalysts. Additionally, suitable elastomeric core materials also include the metallocene-catalyzed polymers disclosed in U.S. Pat. Nos. 5,981,658, 5,824,746, 5,703,166, 6,126,559, 6,228,940, 6,241,626 and 6,414,082. Metallocene-catalyzed polymers can be cross-linked with a cross-linking initiator, such as peroxide, or can be cross-linked by radiation, among other techniques. Additional suitable core materials include poly (styrene-butadiene-styrene) or SBS rubber, SEBS or SEPS block polymers, styrene-ethylene block copolymers, any polar group grafted or copolymerized polymers such as maleic anhydride or succinate modified metallocene catalyzed ethylene copolymer or blends thereof.

Thermoplastic elastomers, such as ionic or non-ionic polyester, polyether, and polyamide may also be present in amounts of less than 50% of the polymeric content of the core may be included to adjust or modify any physical property or manufacturing characteristics. Furthermore, any organo-sulfur or metal-organo-sulfur compound, such as zinc pentachlorothiophenol (ZnPCTP) or pentachlorothiophenol (PCTP), to increase CoR or rigidifying agents, such as those disclosed in U.S. Pat. Nos. 6,162,135, 6,180,040, 6,180,722, 6,284,840, 6,291,592 and 6,339,119 and those disclosed in co-pending U.S. application Ser. No. 09/951,963 entitled "Golf ball Cores Comprising a Halogenated Organo Sulfur Compound" filed on Sep. 13, 2001, may be added.

Outer core can also be made from any of the thermosetting and thermoplastic polymers discussed above. Other suitable polymers for the soft compression and resilient outer cores 15 and 20 include thermosetting syntactic foam with hollow sphere fillers or micro-spheres in a polymeric matrix of epoxy, urethane, polyester or any suitable thermosetting binder, where the cured composition has a specific gravity of less than 1.1 and preferably less than 0.9. Suitable materials may also include polyurethane foam or integrally skinned polyurethane foam that forms a solid skin of polyurethane over a foamed substrate of the same composition. Alternatively, suitable materials may also include a nucleated reaction injection molded polyurethane or polyurea, where a gas, typically nitrogen, is essentially whipped into at least one component of the polyurethane, typically, the pre-polymer, prior to component injection into a closed mold where full reaction takes place resulting in a cured polymer having a reduced specific gravity. Furthermore, a cast or RIM polyurethane or polyurea may have its specific gravity further reduced by the addition of fillers or hollow spheres, etc. Additionally, any number of foamed or otherwise specific gravity reduced thermoplastic polymer compositions may also be used such as metallocene-catalyzed polymers and blends thereof described in U.S. Pat. Nos. 5,824,746 and 6,025,442 and in PCT International Publication No. WO 99/52604. Moreover, any materials described as mantle or cover layer materials in U.S. Pat. Nos. 5,919,100, 6152,834 and 6,149,535 and in PCT International Publication Nos. WO 00/57962 and WO 01/29129 with its specific gravity reduced are suitable materials. Disclosures from these references are hereby incorporated by reference.

Other suitable materials include metallocenes or other single-site catalyzed polymers, ionomers, or other polyolefinic materials polyurethanes, polyurethane ionomers, interpenetrating polymer networks, Hytrel® (polyester-ether elastomer) or Pebax® (polyamide-ester elastomer), etc., which may have specific gravity of less than 1.0. Additionally, suitable unmodified materials are also disclosed in U.S. Pat. Nos. 6,419,535, 6,152,834, 5,919,100, 5,885,172 and WO 00/57962. These references have already been incorporated by reference. The core may also include one or more layers of polybutadiene encased in a layer or layers of polyurethane. Other suitable materials may also include polyurea, polyurethane or polyurea-ionomers, partially or fully neutralized ionomers, metallocene or other single site catalyzed polymers and blends thereof.

As discussed herein, the rigid inner core or pre-formed insert of the present invention is particularly suitable to support a soft outer core. The present invention, however, can also be utilized with a core of any hardness.

Preferably, the rigid inner core or preformed insert has a flexural modulus in the range of about 25,000 psi to about 250,000 psi. More preferably, the flexural modulus of the rigid inner core is in the range of about 75,000 psi to about 225,000 psi, and most preferably in the range of about 80,000 psi to about 200,000 psi. Furthermore, the rigid inner core or preformed insert has durometer hardness in the range of greater than about 40 on the Shore D scale. More preferably, the durometer hardness is greater than about 60 Shore D, and most preferably greater than 65 Shore D. The compression of the rigid inner core or preformed insert is preferably in the range of about 50 to about 120 PGA or Atti. More preferably, the compression is in the range of about 60 to about 110, and most preferably in the range of about 80 to about 100. Shores D hardness is measured according to ASTM D-2240-00, and flexural modulus is measured in accordance to ASTM D6272-98 about two weeks after the test specimen are prepared.

Preferably, the outer core comprises a soft, low compression polymer that is softer than the rigid inner core. The outer core should have a flexural modulus that is at least about 500 psi less than the flexural modulus of the inner core. Preferably, the flexural modulus of the outer core is at least about 1,000 psi less than the flexural modulus of the inner core. More preferably, the flexural modulus of the outer core is at least about 20,000 psi to about 50,000 psi less than the flexural modulus of the inner core. Most preferably, the flexural modulus of the outer core is at least about 100,000 psi less than the flexural modulus of the inner core.

On the other hand, the soft outer core should have a compression that is about 5 to about 100 PGA or Atti less than the compression of the rigid inner core. More preferably, the compression of the outer core is about 20 to about 80 less than the compression of the inner core, and most preferably, the compression of the outer core is about 30 to about 60 less than the compression of the inner core. Additionally, the hardness of the outer core should be about 1 to about 90 points on the Shore D scale less than the hardness of the inner core. More preferably, the differences in hardness should be about 5 to about 70 on the Shore D scale, and most preferably about 10 to about 60 points on the Shore D scale.

One preferred way to achieve the difference is hardness between the inner core and the outer core is to make the inner core from un-foamed polymer, and to make the outer core from foamed polymer selected from the suitable materials disclosed herein. Alternatively, the outer core may be made from these suitable materials having their specific gravity reduced. In this embodiment the inner and outer core can be made from the same polymer or polymeric composition.

The cover 25 should be tough, cut-resistant, and selected from conventional materials used as golf ball covers based on the desired performance characteristics. The cover may be comprised of one or more layers. Cover materials such as ionomer resins, blends of ionomer resins, thermoplastic or thermoset urethane, and balata, can be used as known in the art.

The cover 25 is preferably a resilient, non-reduced specific gravity layer. Suitable materials include any material that allows for tailoring of ball compression, coefficient of restitution, spin rate, etc. and are disclosed in U.S. Pat. Nos. 6,419,535, 6,152,834, 5,919,100 and 5,885,172. Ionomers, ionomer blends, thermosetting or thermoplastic polyurethanes, metallocenes are the preferred materials. The cover can be manufactured by a casting method, reaction injection molded, injected or compression molded, sprayed or dipped method.

When the cover comprises more than one layer, the outer cover layer is formed from a relatively soft thermoset material in order to replicate the soft feel and high spin play characteristics of a balata ball when the balls of the present invention are used for pitch and other "short game" shots. In particular, the outer cover layer should have Shore D hardness of less than 65 or from about 30 to about 60, preferably 35–50 and most preferably 40–45. Additionally, the materials of the outer cover layer must have a degree of abrasion resistance in order to be suitable for use as a golf ball cover. The outer cover layer of the present invention can comprise any suitable thermoset material, which is formed from a castable reactive liquid material. The preferred materials for the outer cover layer include, but are not limited to, thermoset urethanes and polyurethanes, thermoset urethane ionomers and thermoset urethane epoxies. Examples of suitable polyurethane ionomers are disclosed in U.S. Pat. No. 5,692,974 entitled "Golf Ball Covers," the disclosure of which is hereby incorporated by reference in its entirety in the present application. Thermoset polyurethanes and polyureas are preferred for the outer cover layers of the balls of the present invention.

FIGS. 5(*a*), 5(*b*), 5(*c*), and 5(*d*) illustrate other embodiments of the rigid pre-formed insert inner core in accordance to the present invention. A ball-and-rod insert or inner core 84, shown in FIG. 5(*a*), comprises a plurality of balls 86 positioned at the distal ends of connecting rods 88. As illustrated, rods 88 are connected about their midpoints thereby allowing insert 84 to be radially symmetrical. Since rods 88 and balls 86 are rigid and are evenly distributed within a golf ball, the deformation of the softer core material surrounding insert 84 caused by club impact is reduced.

Similarly, balls 88 can be enlarged to further increase the resistance against deformation. For example, the ball-and-rod configuration becomes a mushroom configuration 90 as shown in FIG. 5(*b*) or an anchor configuration 92 as shown in FIG. 5(*c*). FIG. 5(*d*) illustrates another variation of the ball-and-rod configuration. The webbed ball-and-rod pre-formed insert 94 comprises a plurality of balls 88 connected together by rigid webbed legs 96. The webbed legs formed a rigid network near the surface of the ball to resist deformation of the ball. The balls 88 of insert 94 may also be enlarged to have a mushroom shape or an anchor shape.

FIGS. 6(*a*)–6(*c*) illustrate other embodiments of the pre-formed insert inner core in accordance to the present invention. Insert 98 shown in FIG. 6(*a*) is substantially similar to the ball-and-rod insert shown in FIG. 5(*a*). Pre-formed insert 98 comprises a plurality of balls 100 connected by rods 102 to hub 109. Hub 109 anchors rods 102 to provide additional structural rigidity. Also, insert 98 may have a mushroom or anchor configuration.

FIG. 6(*b*) illustrates a hub-and-rod insert 114, which is similar to the insert 98 of FIG. 6(*a*), except that insert 114 has hub 116 and rods 118, but does not have the balls disposed at the end of rods 118. Additionally, hub 116 is different than hub 109 in that the locations where rods 118 merge into hub 116 are preferably smooth and without sharp interconnecting lines. This feature provides additional structural integrity to the insert.

FIG. 6(*c*) shows insert 120, which comprises an optional center 122 surrounded by a plurality of rigid rings 124. Center 122 can be hollow to allow soft core material to be molded through. Alternatively, rigid rings 124 are integral solid rigid disks to provide additional rigidity for the ball. Rings 124 can also help position and center insert 120 in the mold cavity.

In accordance to yet another aspect of the invention, FIGS. 7(*a*), 7(*b*) and 7(*c*) illustrate other embodiments of the rigid pre-formed insert as a continuous configuration having chambers that may be solid, hollow, or partially filled. As shown in FIG. 7(*a*), insert 132 comprises a shell 133 with openings 134 on its surface. Core materials can be molded around the open shell 133 and penetrate its interior through openings 134. Insert 132 may be made from a rigid material and the core material can be a soft, low compression material. Alternatively, insert 132, shown in FIG. 7(*b*), may have chambers 136 filled or partially filled with a rigid material. On the other hand, insert 132, shown in FIG. 7(*c*), may have a hub 138 centrally located in open rigid shell 133 and connected by a plurality of rods, similar to rods 102 of insert 98, to shell 133 to increase the rigidity of insert 132.

Golf balls, made in accordance to the embodiments of the present invention discussed above, exhibit higher CoR than conventional golf balls. More particularly, golf balls made according to the present invention have CoR higher than Sample-48 discussed above.

While it is apparent that the illustrative embodiments of the invention disclosed herein fulfill the objectives stated above, it is appreciated that numerous modifications and other embodiments may be devised by those skilled in the art. One such modification is that the outer surface can be flush with the inner surface free ends or it can extend beyond the free ends. Therefore, it will be understood that the appended claims are intended to cover all such modifications and embodiments, which would come within the spirit and scope of the present invention.

We claim:

1. A golf ball comprising a core, which comprises a re-formed non-spherical insert embedded within a polymeric core material and is encased by a cover, wherein the golf ball has a coefficient of restitution of at least 0.810 at a collision speed of about 125 feet per second or higher and the non-spherical insert has a flexural modulus in the range of about 25,000 psi to about 250,000 psi.

2. The golf ball of claim 1, wherein the coefficient of restitution's at least 0.790 at collision speed of about 140 feet per second or higher.

3. The golf ball of claim 2, wherein the coefficient of restitution's at least 0.760 at collision speed of about 160 feet per second or higher.

4. A golf ball comprising a core, which comprises a pre-formed non-spherical insert having a flexural modulus in the range of about 25,000 psi to about 250,000 psi embedded within a polymeric core material and is encased by a cover, wherein the golf ball has a first coefficient of restitution of at least 0.810 1 at a collision speed of about 160 feet per second or higher against a flexible impact surface, wherein the impact surface has a second coefficient of restitution of about 0.830.

5. The golf ball of claim 1, wherein the pre-formed non-spherical insert has a flexural modulus in the range of about 75,000 psi to about 225,000 psi.

6. The golf ball of claim 5, wherein the pre-formed non-spherical insert has a flexural modulus in the range of about 80,000 psi to about 200,000 psi.

7. The golf ball of claim 1, wherein the pre-formed non-spherical insert is symmetrical.

8. The golf ball of claim 7, wherein the insert comprises a central portion and a plurality of projections.

9. The golf ball of claim 8, wherein the projections comprise a substantially conical head disposed at the distal end of each projection.

10. The golf ball of claim 8, wherein outermost surfaces of the conical heads lie on a spherical surface.

11. The golf ball of claim 7, wherein the projections are separated by predetermined gaps.

12. The golf ball of claim 7, wherein the insert comprises a plurality of connected rods and a plurality of balls disposed at the distal ends of the rods.

13. The golf ball of claim 7 wherein the insert comprises a plurality of connected rods and a plurality of mushroom-shaped heads disposed at the distal ends of the rods.

14. The golf ball of claim 7, wherein the insert comprises a plurality of connected rods and a plurality of anchor-shaped heads disposed at the distal ends of the rods.

15. The golf ball of claim 12, wherein the insert further comprises a hub connected to said rods.

16. The golf ball of claim 7, wherein the insert comprises a plurality of rods connected to a central hub.

17. The golf ball of claim 7, wherein the insert comprises a plurality of interconnected rings.

18. The golf ball of claim 17, wherein the insert further comprises a center.

19. The golf ball of claim 7, wherein the insert comprises a plurality of interconnected disks.

20. The golf ball of claim 7, wherein the insert comprises a hollow shell having openings on its surface.

21. The golf ball of claim 20, wherein the shell comprises rigid chambers on its surface.

22. The golf ball of claim 20, wherein the shell further comprises a center hub connected to the shells by rods.

23. The golf ball of claim 1, wherein the pre-formed non-spherical insert has compression in the range of about 50 Atti to about 120 Atti.

24. The golf ball of claim 23, wherein the pre-formed non-spherical insert has compression in the range of about 60 Atti to about 110 Atti.

25. The golf ball of claim 24, wherein the pre-formed non-spherical insert has compression in the range of about 80 Atti to about 100 Atti.

26. The golf ball of claim 1, wherein the flexural modulus of the polymeric core material is at least about 500 psi less than the flexural modulus of the pre-formed non-spherical insert.

27. The golf ball of claim 26, wherein the flexural modulus of the polymeric core material is at least about 1000 psi less than the flexural modulus of the pre-formed non-spherical insert.

28. The golf ball of claim 27, wherein the flexural modulus of the polymeric core material is about 20,000 psi to about 50,000 psi less than the flexural modulus of the pre-formed non-spherical insert.

29. The golf ball of claim 1, wherein the flexural modulus of the polymeric core material is at least about 100,000 psi less than the flexural modulus of the pre-formed non-spherical insert.

30. The golf ball of claim 23, wherein the compression of the polymeric core material is about 5 to 100 Atti less than the compression of the pre-formed non-spherical insert.

31. The golf ball of claim 30, wherein the compression of the polymeric core material is about 20 to 80 Atti less than the compression of the pre-formed non-spherical insert.

32. The golf ball of claim 31, wherein the compression of the polymeric core material is about 30 to 60 Atti less than the compression of the pre-formed non-spherical insert.

33. The golf ball of claim 1, wherein the pre-formed non-spherical insert has a durometer value of greater than about 40 Shore D.

34. The golf ball of claim 33, wherein the preformed non-spherical insert has a durometer value of greater than about 60 Shore D.

35. The golf ball of claim 34, wherein the pre-formed non-spherical insert has a durometer value of greater than about 65 Shore D.

36. A golf ball comprising a core encased by a cover, wherein the core comprises a pre-formed, symmetrical, non-spherical insert encased by a polymeric core material, wherein the insert has a flexural modulus in the range of about 25,000 psi to about 250,000 psi and the polymeric core material has a flexural modulus of at least about 500 psi less than the flexural modulus of the insert.

37. The golf ball of claim 36, wherein the flexural modulus of the insert is in the range of about 75,000 psi to about 225,000 psi.

38. The golf ball of claim 37, wherein the flexural modulus of the insert is in the range of about 80,000 psi to about 200,000 psi.

39. The golf ball of claim 36, wherein the polymeric core material has a flexural modulus of at least about 1000 psi less than the flexural modulus of the insert.

40. The golf ball of claim 39, wherein the polymeric core material has a flexural modulus of at least about 20,000 psi to about 50,000 psi less than the flexural modulus of the insert.

41. The golf ball of claim 39, wherein the polymeric core material has a flexural modulus of at least 100,000 psi less than the flexural modulus of the insert.

42. A golf ball comprising a core encased by a cover, wherein the core comprises a pre-formed, symmetrical, non-spherical insert encased by a polymeric core material, wherein the insert has a compression in the range of about 50 Atti to about 120 Atti and the polymeric core material has a compression of at least about 5 Atti to about 100 Atti less than the compression of the insert.

43. The golf ball of claim 42, wherein the compression of the insert is in the range of about 60 Atti to about 110 Atti.

44. The golf ball of claim 43, wherein the compression of the insert is in the range of about 80 Atti to about 100 Atti.

45. The golf ball of claim 42, wherein the polymeric core material has a compression of at least about 20 Atti to about 80 Atti less than the compression of the insert.

46. The golf club of claim 45, wherein the polymeric core material has a compression of at least about 30 Atti to about 60 Atti less than the compression of the insert.

47. The golf ball of claim 36, wherein the insert is made from an un-foamed polymer and the polymeric core material is foamed.

48. The golf ball of claim 47, wherein the insert and the polymeric core material are made from the same polymer.

49. The golf ball of claim 36, wherein the insert is made from a polymer with its specific gravity reduced.

50. A golf ball comprising a core encased by a cover, wherein the core comprises a pre-formed, symmetrical, non-spherical insert encased by a polymeric core material, wherein the insert has a flexular modulus in the range of 25,000 psi to about 250,000 psi and a Shore D hardness in the range of greater than about 40 and the polymeric core material has a Shore D hardness of at least about 1 less than the hardness of the insert.

* * * * *